US007980738B2

(12) United States Patent
Chiang

(10) Patent No.: US 7,980,738 B2
(45) Date of Patent: Jul. 19, 2011

(54) MULTI-SOURCE SHADOWLESS OPERATING LAMP

(75) Inventor: Chun-Shen Chiang, Kinkou Township, Taipei County (TW)

(73) Assignee: Mediland Enterprise Corporation, Taoyuan County (TW)

( * ) Notice: Subject to any disclaimer, the term of this patent is extended or adjusted under 35 U.S.C. 154(b) by 99 days.

(21) Appl. No.: 12/580,482

(22) Filed: Oct. 16, 2009

(65) Prior Publication Data

US 2011/0090707 A1 Apr. 21, 2011

(51) Int. Cl.
*F21S 8/00* (2006.01)

(52) U.S. Cl. ..... 362/427; 362/428; 362/804

(58) Field of Classification Search ..... 362/427, 362/428, 452, 184, 804, 405
See application file for complete search history.

(56) References Cited

U.S. PATENT DOCUMENTS

| | | | | |
|---|---|---|---|---|
| 7,562,999 | B2 * | 7/2009 | Chen | 362/239 |
| 7,810,948 | B2 * | 10/2010 | Ogashiwa | 362/239 |
| 2003/0185009 | A1 * | 10/2003 | Walters | 362/276 |
| 2011/0051434 | A1 * | 3/2011 | Lin | 362/396 |

* cited by examiner

*Primary Examiner* — Evan Dzierzynski
(74) *Attorney, Agent, or Firm* — Muncy, Geissler, Olds & Lowe, PLLC

(57) ABSTRACT

A multi-source shadowless operating lamp is disclosed, which includes a central base, a link element received in the central base, and a plurality of spotlights mounted on a peripheral of the central base and spaced a distance apart from each other. A light field is defined below the central base and extends perpendicular to the central base. Each spotlight defines a light focus spot through the light field. The focus spots exactly pass the same height in the light field. Each spotlight includes a lamp shell connecting with the central base, a dissipation substrate accommodated in the lamp shell, and a plurality of LED sets. The LED sets at different positions respectively cast light to the focus spot of the spotlight. An angle between the dissipation substrate and the light shell is adjustable to change position of the focus spot of the spotlight relative to the light field.

10 Claims, 10 Drawing Sheets

MULTI-SOURCE SHADOWLESS OPERATING LAMP

BACKGROUND OF THE INVENTION (a) Field of the Invention

The present invention relates to a multi-source shadowless operating lamp, and particularly to a multi-source shadowless operating lamp which has dissipation substrates, a plurality of LED (Light Emitting Diode) sets being mounted on the dissipation substrates and having different angles for respectively corresponding to a fixed light field, and a link element automatically adjusting the angles for varying height of light, thereby overlapping a light field and preventing against dust.

(b) Description of the Prior Art

Optical light apparatus applied on medical operation is generally shadowless and is distinguished from ordinary illuminative devices. A conventional shadowless operating lamp has a central base on a center thereof, and forms a fixed light field below the central base. A plurality of illumination bodies are symmetrically around the central base. The illumination bodies are pivoted to the central base for adjusting angles with respect to light sources. Each illumination body has a cover for pivoting to the central base, and a plurality of mounting bases in the cover for retaining to a dissipation plate. The mounting bases receive a plurality of light emission diodes (LEDs). A spotlight lens controls the LEDs to adjust light focus spot, focusing light of the LEDs on a common focus spot, and adjust the illumination bodies to focus on a common target field. Thus, a light field of a Gaussian distribution is formed on the target field.

The conventional shadowless operating lamp has deficiencies in structure as follows:

1. Surgeons need to adjust light field of the illumination bodies to discern operating positions. In general, the covers of the illumination bodies are pushed to rotate the illumination bodies relative to the central base. Due to the pivoting connection between the covers and the central base, when the angles therebetween are changed, dust may remain on joints between the covers and the central base, which can not comply with dustless standard in surgical room and increase cost of sanitary and maintenance.
2. The LEDs are mounted on the mounting bases and fixed on the dissipation plates. The generated heat of the LEDs tends to damage ambience thereof. In addition, heat of the LEDs is indirectly conducted to the dissipation plate through the mounting bases, influencing dissipation effect and shortening lifespan of the LEDs.
3. Positions of the LEDs are different, so an extra spotlight lens is required to adjust the LEDs of the illumination body on a common focus spot. This is inconvenient and increases expense of the extra spotlight lens.

SUMMARY OF THE INVENTION

Accordingly, an object of the present invention is to provide a multi-source shadowless operating lamp which integrates light focusing and heat dissipation on a common dissipation substrate, making light area of spotlights overlapped and adjusting height of focus spots of the spotlights in a light field. At the same time, the adjustment operation prevents from dust and vastly costs down in maintenance.

The multi-source shadowless operating lamp of the present invention comprises a central base, a link element received in the central base, and a plurality of spotlights mounted on a peripheral of the central base and spaced a distance apart from each other. A light field is defined below the central base and extends perpendicular to the central base. Each spotlight defines a light focus spot through the light field, the focus spots exactly passing the same height in the light field. Each spotlight includes a lamp shell connecting with the central base, a dissipation substrate accommodated in the lamp shell, and a plurality of LED sets. A pivot portion is formed on an end of the dissipation substrate and near the central base for pivoting to the link element. A lock portion is formed on another end of the dissipation substrate for locking with the lamp shell. The dissipation substrate defines a plurality of slots in a bottom thereof. Each slot has a mount surface on a bottom thereof. The mount surface has an extending line extending perpendicular thereto and through the focus spot of the spotlight. The LED sets are mounted on the mount surfaces of the dissipation substrate and correspond to the extending lines of the mount surfaces. The LED sets at different positions respectively cast light to the focus spot of the spotlight.

An angle between the dissipation substrate and the light shell is adjustable to change position of the focus spot of the spotlight relative to the light field. The link element brings the focus spots of the spotlights to change height relative to the light field, making the focus spots of the spotlights be positioned at the same height in the light field.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
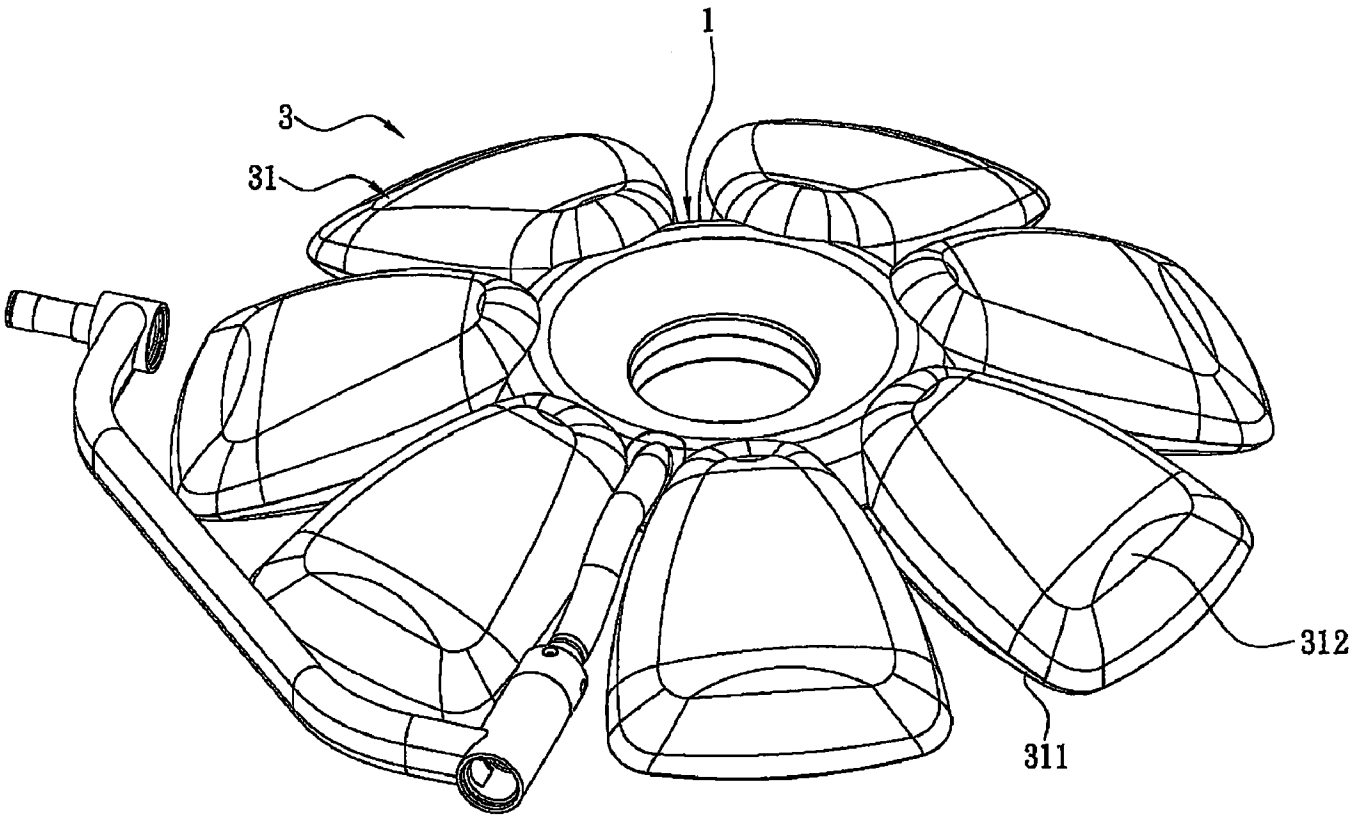
FIG. 1 is a perspective view of a multi-source shadowless operating lamp according to the present invention.
Figure 2:
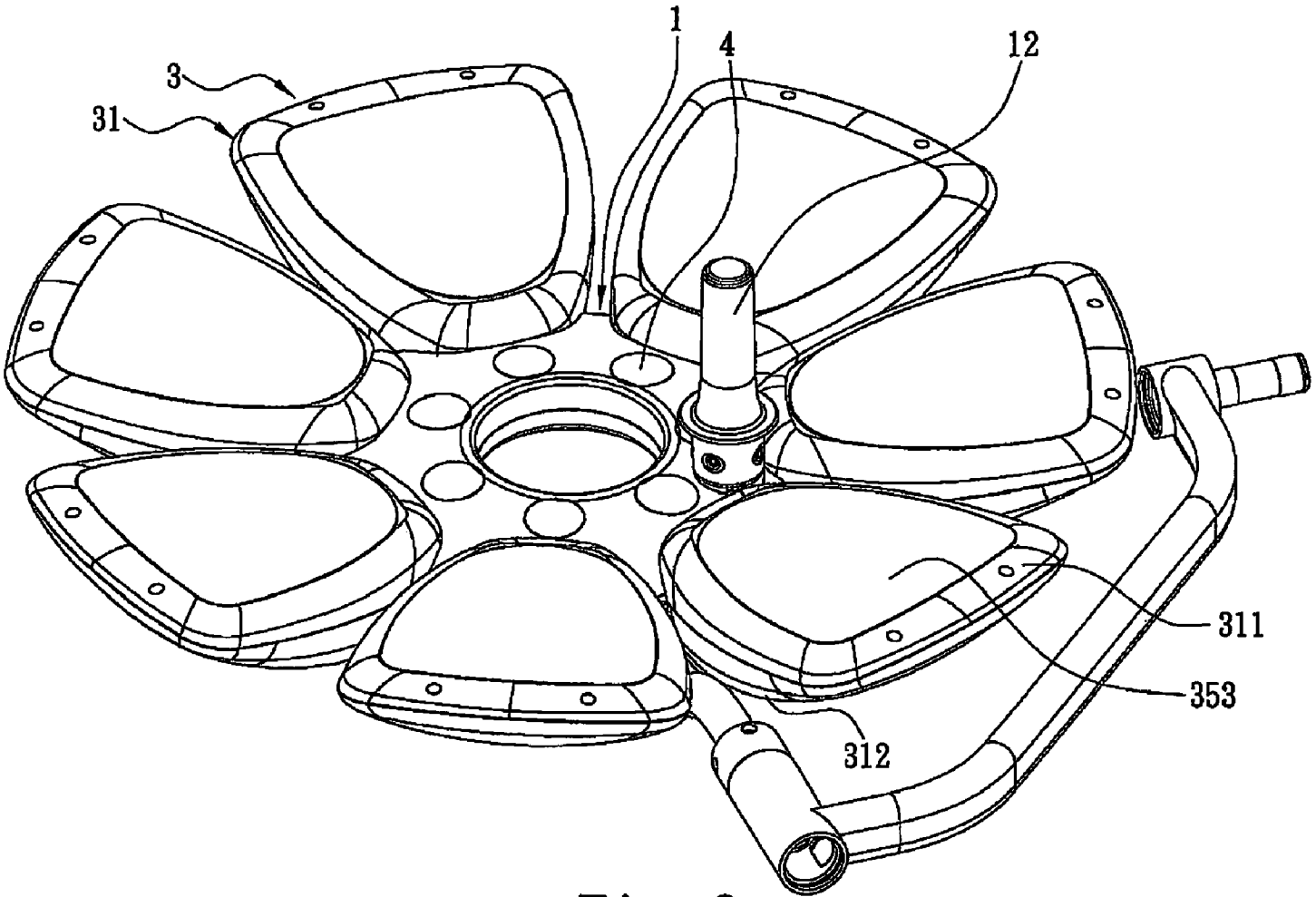
FIG. 2 is another perspective view of the multi-source shadowless operating lamp from another aspect.

Referring to FIGS. 1 through 4, a multi-source shadowless operating lamp in accordance with the present invention comprise a central base 1, a link element 2, seven spotlights 3 and seven auxiliary light units 4.

A light field A is defined below the central base 1 and extends perpendicular to the central base 1. The central base 1 has a gear 11, and a manipulation portion 12 for driving the gear 11 to rotate.

The link element 2 is received in the central base 1, and has a support rack 21 mounted on the central base 1. A gear rod 22 is connected to the support rack 21 for meshing with the gear 11 of the central base 1. Seven connecting levers 23 extend from the support rack 21 and are spaced a distance apart from each other. Each connecting lever 23 includes a first rotating bar 231 and a second rotating bar 232. An omni-directional joint 233 is mounted on an end of the first rotating bar 231 for connecting with the support rack 21, and a second omni-directional joint 234 is mounted on another end of the first rotating bar 231 (shown in FIG. 5).

The seven spotlights 3 are mounted on a peripheral of the central base 1 and are spaced a distance apart from each other. Each spotlight 3 defines a light focus spot B through the light field A. The focus spots B exactly pass the same height in the light field A, making light area of the spotlights 3 overlapped.

Figure 5:
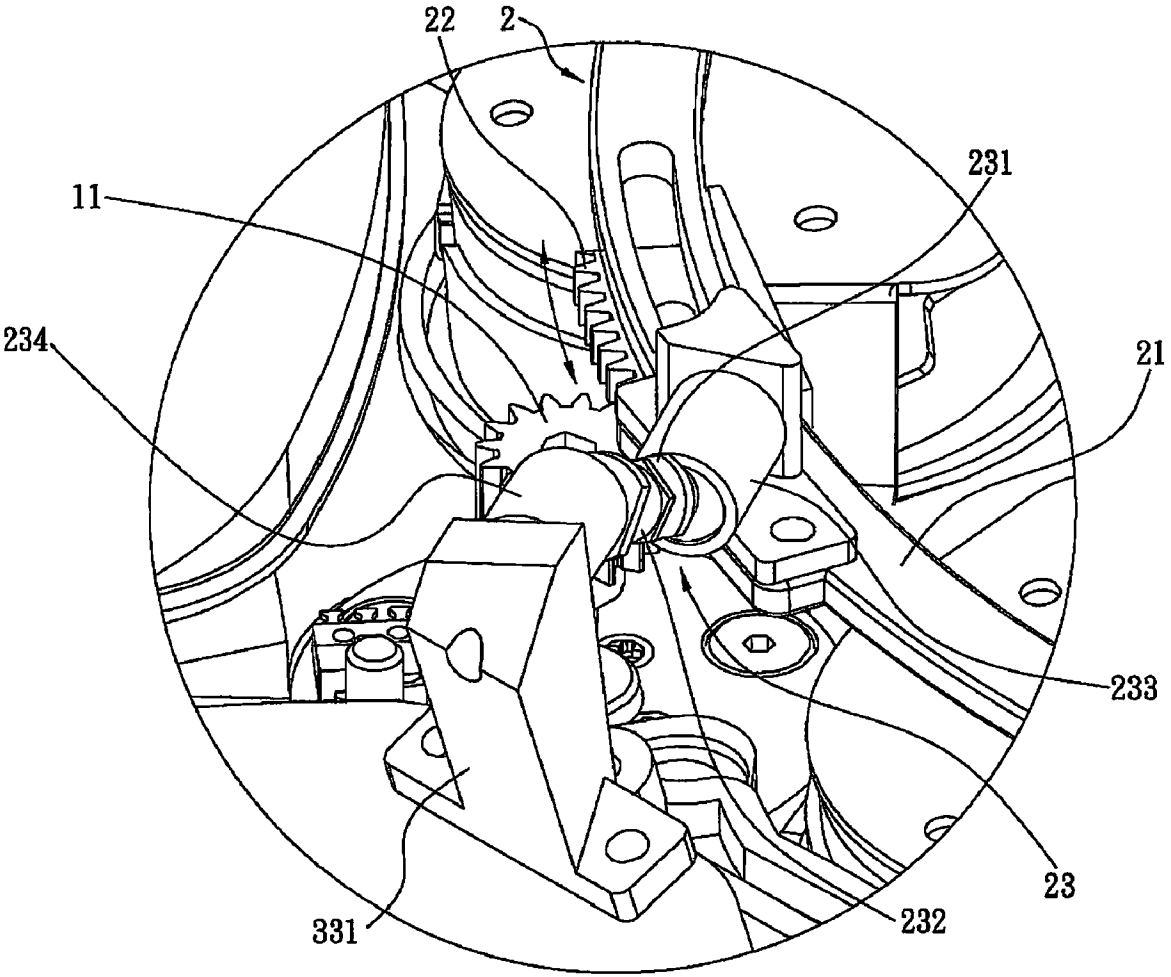
FIG. 5 is a partially enlarged view of a pivot portion and a link element of the multi-source shadowless operating lamp, wherein the pivot portion and the link element are pivoted.
Figure 6:
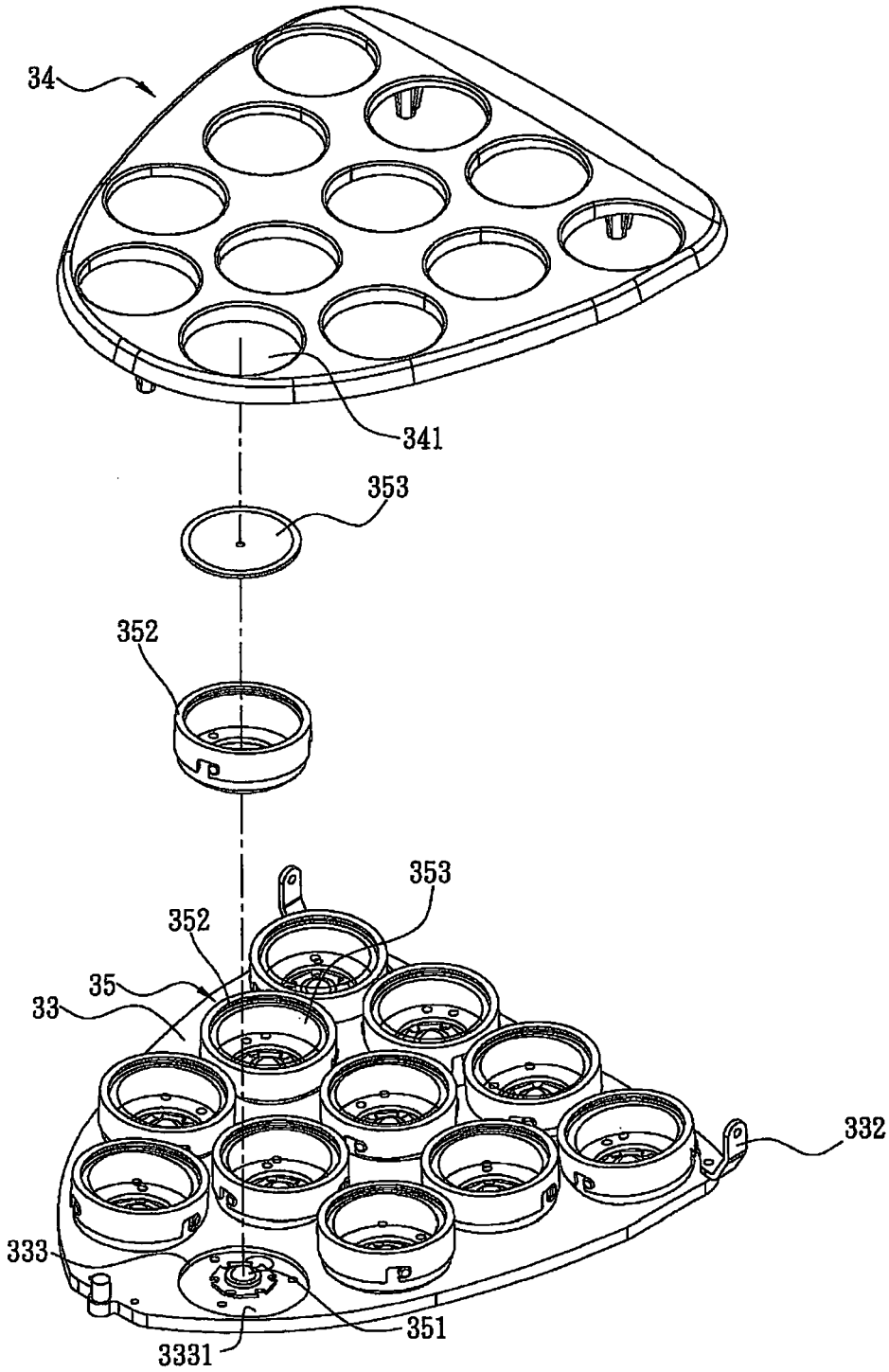
FIG. 6 is an exploded view of a spotlight of the multi-source shadowless operating lamp.
Figure 7:
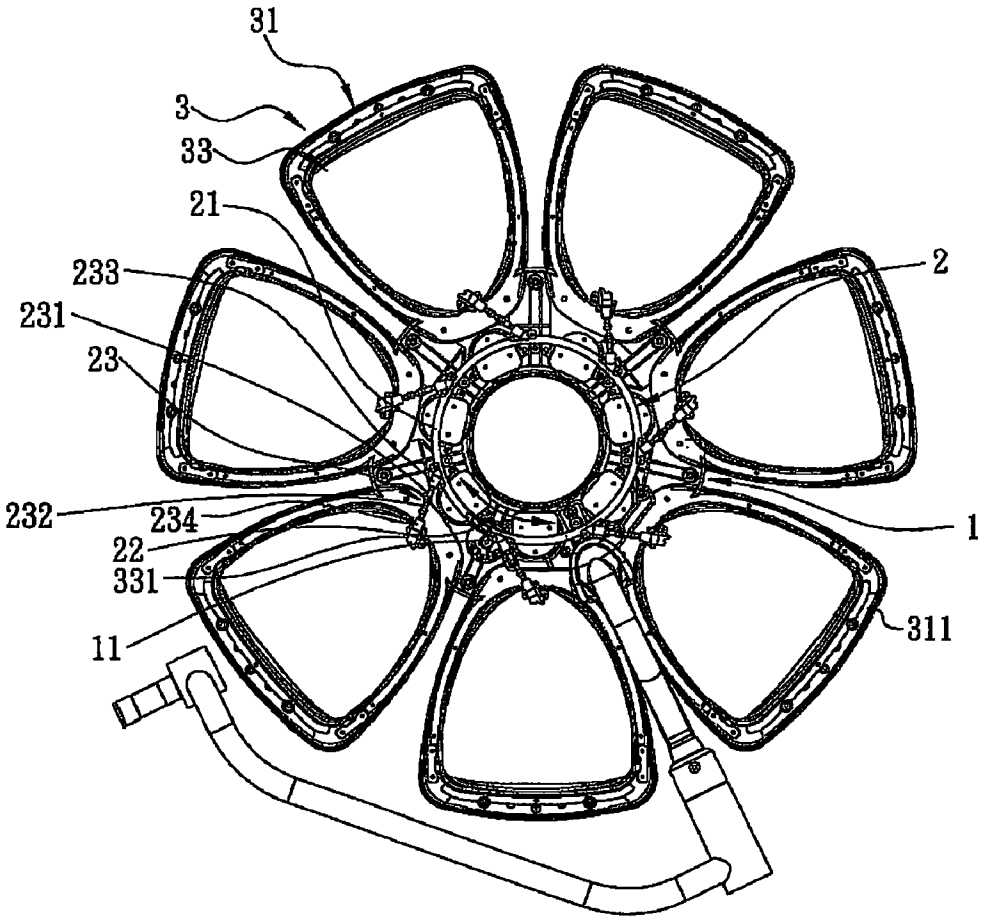
FIG. 7 is a partially top view of the multi-source shadowless operating lamp of FIG. 3.
Figure 8:
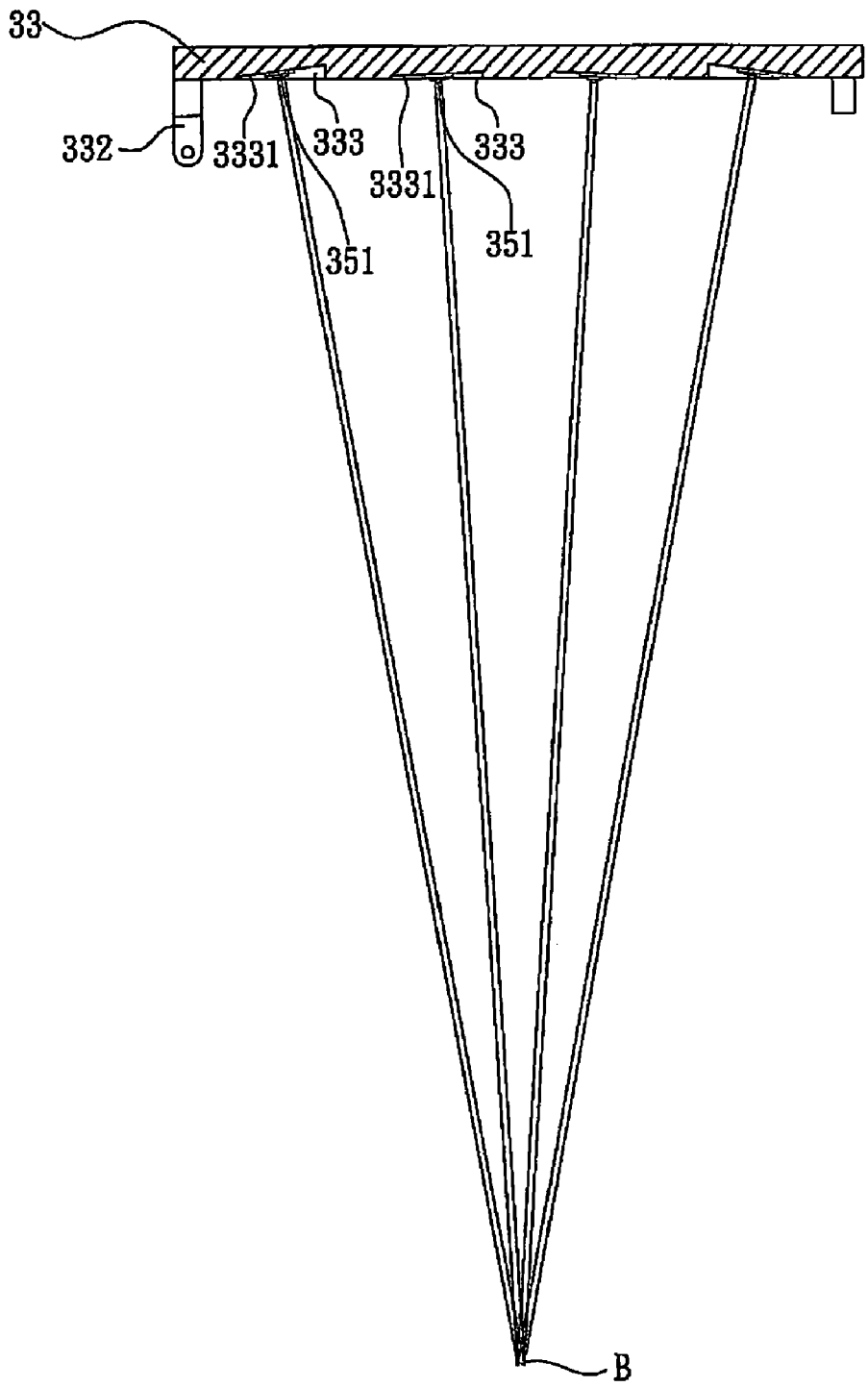
FIG. 8 schematically shows light path of the spotlight.
Figure 9:
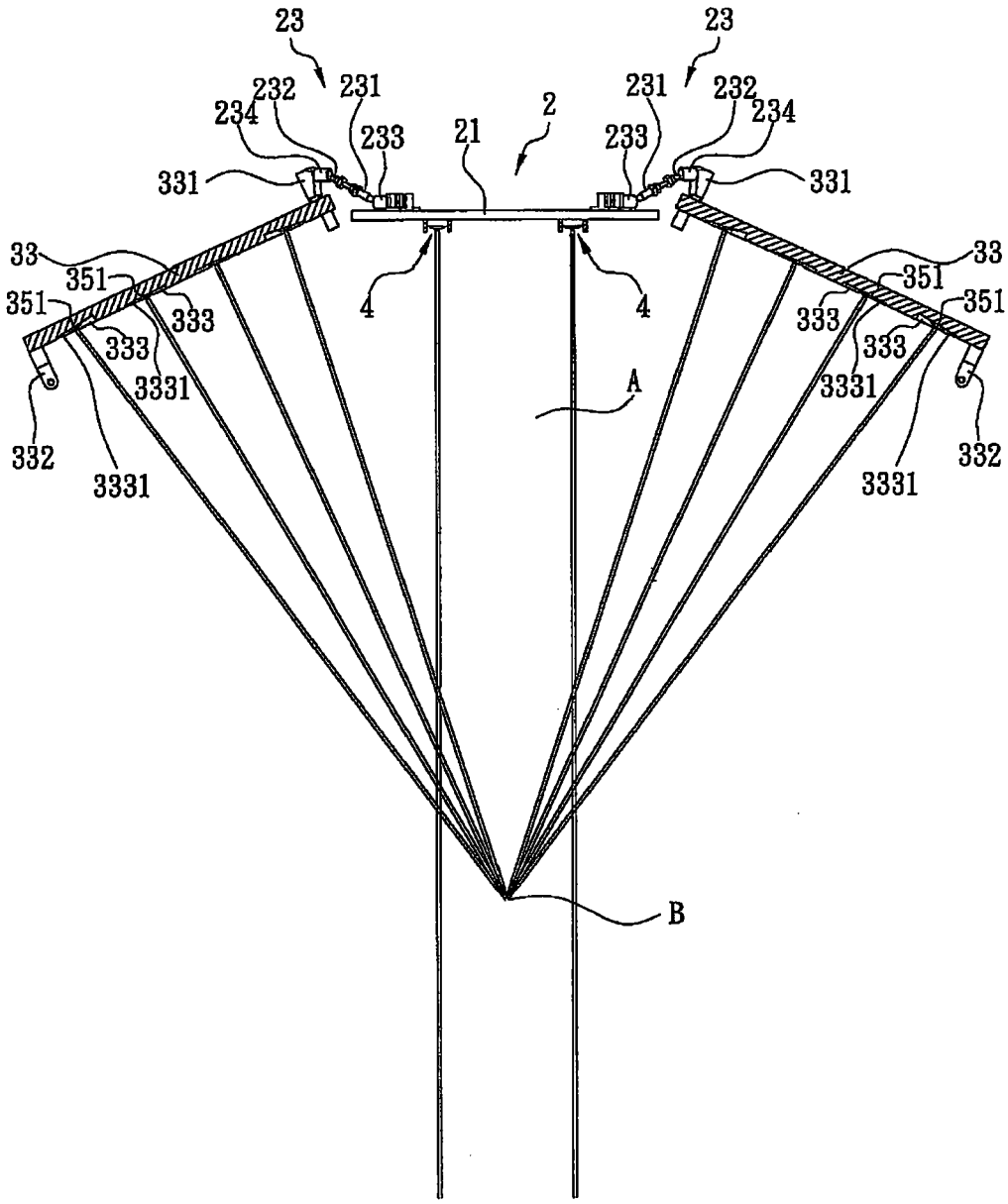
FIG. 9 schematically shows adjustment of light path of the spotlight.
Figure 10:
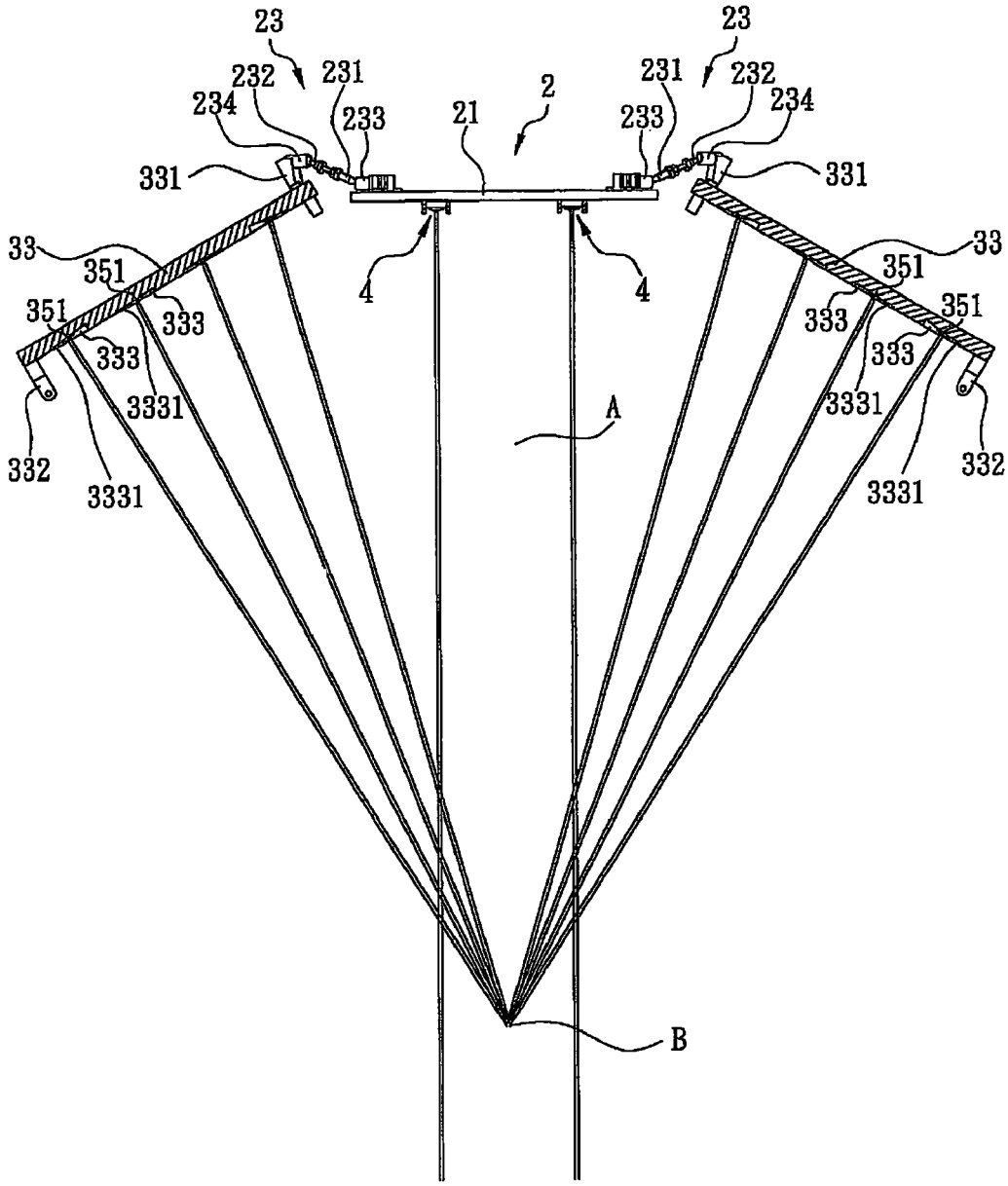
FIG. 10 schematically shows adjustment of light path of the spotlight from another aspect.

Each spotlight 3 includes a lamp shell 31, an abut portion 32, a dissipation substrate 33, a cover 34 and twelve LED sets 35 (see FIGS. 5, 6 and 7).

Figure 3:
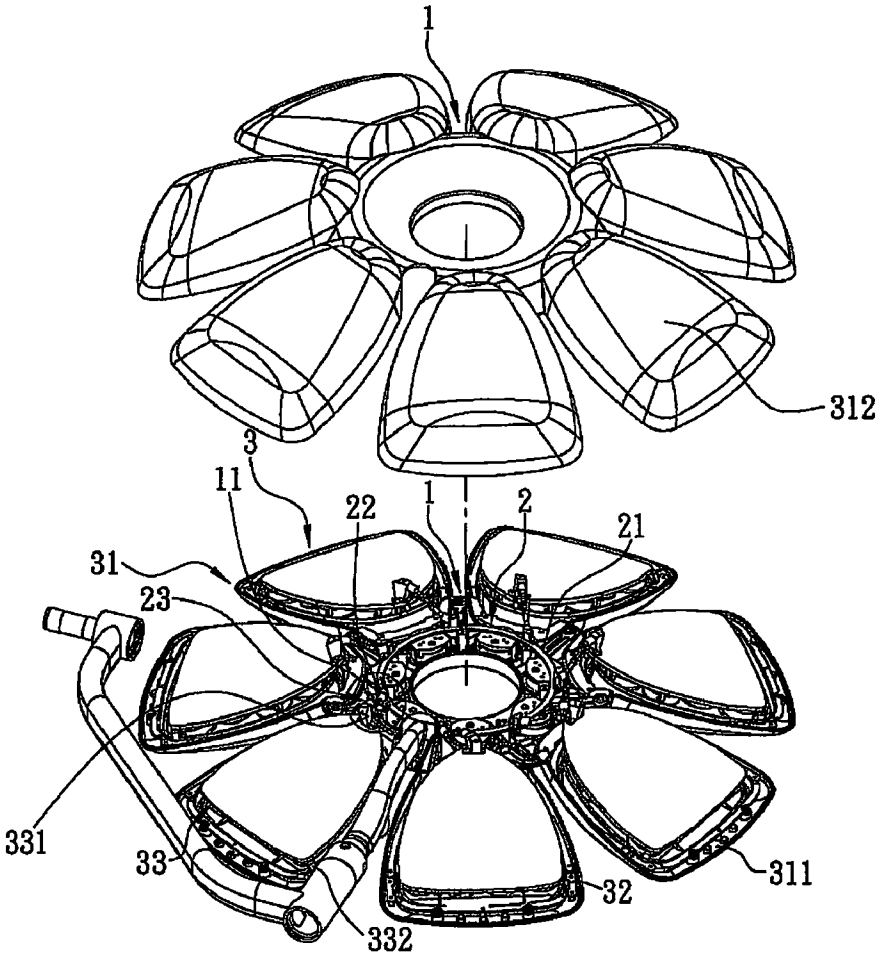
FIG. 3 is a partially exploded view of the multi-source shadowless operating lamp of FIG. 1.
Figure 4:
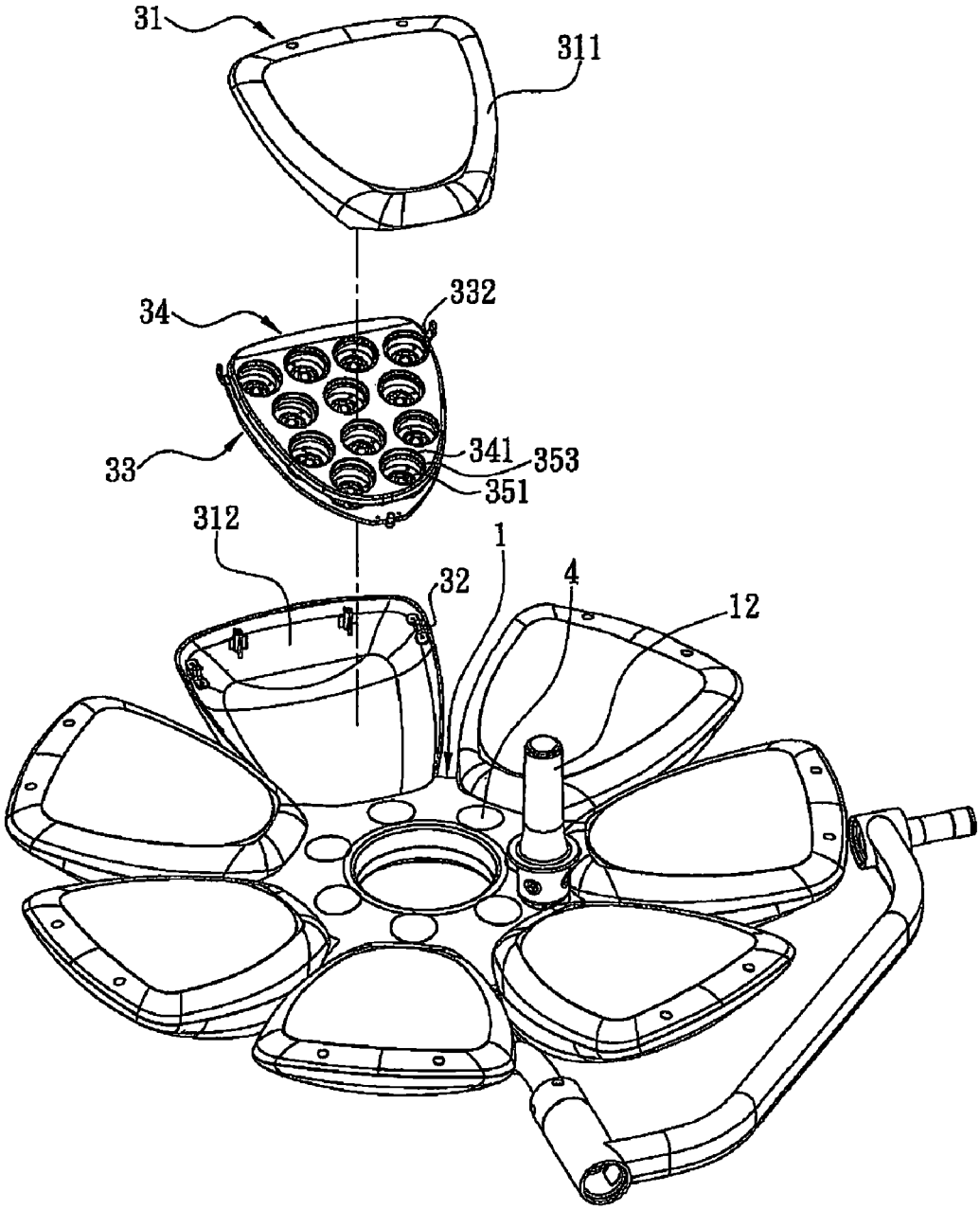
FIG. 4 is a partially exploded view of a spotlight of the multi-source shadowless operating lamp.

The lamp shell 31 connects with the central base 1, and has a shell body 311 and a shell back 312 mounted together (see FIGS. 3 and 4).

The abut portion 32 is accommodated in the lamp shell 31, and has an end on the shell body 311 (see FIG. 4).

The dissipation substrate 33 is accommodated in the lamp shell 31. A bottom surface of the dissipation substrate 33 has enlarged area toward a direction apart from the central base 1. A pivot portion 331 is formed on an end of the dissipation substrate 33 and near the central base 1 for pivoting to the second omni-directional joint 234 of the link element 2. A lock portion 332 is formed on another end of the dissipation substrate 33 for locking with another end of the abut portion 32. The dissipation substrate 33 defines twelve slots 333 in a bottom thereof. The slots 333 are distributed in multiple arrays. In another embodiment, the slots 333 may be distributed according to area of the bottom of the dissipation substrate 33. The number of the slots 333 of each array increases toward a direction far away from the central base 1. Each slot 333 has a mount surface 3331 on a bottom thereof. Each mount surface 3331 has an extending line extending perpendicular thereto and through the focus spot B of the spotlight 3 (see FIGS. 4, 5, 6 and 7).

The cover 34 is received in the lamp shell 31 and below the dissipation substrate 33 for combining with the dissipation substrate 33. The cover 34 defines twelve through holes 341 (shown in FIG. 4).

The twelve LED sets 35 have LED units 351 mounted on the mount surfaces 3331 of the dissipation substrate 33 and corresponding to the extending lines of the mount surfaces 3331. The LED units 351 at different positions respectively cast light to the focus spots B. The LED units 351 lock with the dissipation substrate 33 directly or indirectly by extra elements (not shown). Each LED set 35 has a ring portion 352 for corresponding to the through hole 341 and surrounding a peripheral of the LED unit 351. The ring portion 352 is made of plastic and can focus light. A lens 353 is provided on the ring portion 352 and is located between the LED unit 351 and the focus spot B of the spotlight 3. The lens 353 is able to focus light to vary light, thereby enhancing illumination of the LED units 351 (shown in FIGS. 5, 6, 7, 8 and 9).

The seven auxiliary light units 4 are respectively provided on a bottom of the central base 1 and are spaced a distance apart from each other for casting light to the light field A as auxiliary light source, thereby enhancing illumination of the spotlights 3 (shown in FIGS. 2, 4, 9, 10).

As shown in FIGS. 3, 5 and 7, when a surgeon is operating, the central base 1 is moved to make the light field A cast light to a desired position. The manipulation portion 12 is manipulated to drive the gear 11 to rotate, bringing the gear rod 22 to rotate and making the support rack 21 to rotate. The link lever 23 is brought to move with the rotate course of the support rack 21. The dissipation substrate 33 forms an angle relative to the light shell 31. The angle between the dissipation substrate 33 and the light shell 31 is adjustable to change positions of the focus spot B of the spotlight relative to the light field A for generating a light area of Gaussian distribution. The link element 2 brings the focus spots B of the spotlights 3 to change height relative to the light field A, making the focus spots B of the spotlights 3 be positioned at the same height in the light field A. When light source is weak, the auxiliary light units 4 may be turn on to supplement illumination of the spotlights 3, making the light area more luminous and even (see FIGS. 8, 9 and 10).

The multi-source shadowless operating lamp of the present invention has the following advantages:

1. The LED units 351 are directly mounted on the dissipation substrate 33. Reflection heat of the LED units 351 are conducted directly to the dissipation substrate 33 to be given out, thereby increasing heat dissipation effect and lifespan of the LED units 351.
2. The dissipation substrate 33 defines slots 333 on different positions thereof. The slots 333 form mount surfaces 3331 corresponding to a common focus spot, making the LED units 351 on the mount surfaces 3331 correspond to a common focus spot. The dissipation substrate 33 is pivoted to the link element 2 for controlling the light area of the spotlights 3 to overlap at different height of the light field A. Thus the operating lamp can focus light.
3. The manipulation portion 12 is manipulated easily to drive the link element 2, bringing the dissipation substrate 33 in the lamp shell 31 of the spotlight 3 to be inclined and rotate. The focus spots B of the spotlights 3 are positioned at the same height as the light field A. A light area of Gaussian distribution is generated to provide the surgeon with sufficient light source reflection. Rotation of the lamp shells 31 is avoided, so there is no exploded gap between the spotlights 3 and the central base 1. Therefore, no dust remains in the lamp shell 31 of the spotlights 3, decreasing maintenance cost.

The shadowless operating lamp overcomes deficiencies of the prior art, and effectively adjust height of the focus spot B of the spotlights 3 in the light field A. Operation of adjustment also prevents against dust, decreasing cost of manufacturing and maintenance.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A multi-source shadowless operating lamp comprising:

a central base, a light field being defined below the central base and extending perpendicular to the central base;

a link element received in the central base; and a plurality of spotlights mounted on a peripheral of the central base and spaced a distance apart from each other, each spotlight defining a light focus spot through the light field, the focus spots exactly passing the same height in the light field, each spotlight including:

a lamp shell connecting with the central base;

a dissipation substrate accommodated in the lamp shell, a pivot portion being formed on an end of the dissipation substrate and near the central base for pivoting to the link element, a lock portion being formed on another end of the dissipation substrate for locking with the lamp shell, the dissipation substrate defining a plurality of slots in a bottom thereof, each slot having a mount surface on a bottom thereof, the mount surface having an extending line extending perpendicular thereto and through the focus spot of the spotlight; and a plurality of LED (Light Emitting Diode) sets mounted on the mount surfaces of the dissipation substrate and corresponding to the extending lines of the mount surfaces, the LED sets at different positions respectively casting light to the focus spot;

wherein an angle between the dissipation substrate and the light shell is adjustable to change positions of the focus spot of the spotlight relative to the light field, the link element bringing the focus spots of the spotlights to change height relative to the light field, making the focus spots of the spotlights be positioned at the same height in the light field.

2. The multi-source shadowless operating lamp as claimed in claim 1, wherein auxiliary light units are respectively provided on a bottom of the central base for casting light to the light field.

3. The multi-source shadowless operating lamp as claimed in claim 1, wherein the link element has a support rack mounted on the central base, a gear rod being connected to the support rack for meshing with a gear of the central base, a plurality of connecting levers extending from the support rack and being spaced a distance apart from each other, ends of the connecting levers pivoting to the pivot portions of the spotlights.

4. The multi-source shadowless operating lamp as claimed in claim 3, wherein the central base has a manipulation portion for driving the gear to rotate and bringing the gear rod of the link element to rotate.

5. The multi-source shadowless operating lamp as claimed in claim 3, wherein each connecting lever includes a first rotating bar and a second rotating bar, an omni-directional joint being mounted on an end of the first rotating bar for connecting with the support rack, and a second omni-directional joint being mounted on another end of the first rotating bar for connecting with the pivot portion of the dissipation substrate.

6. The multi-source shadowless operating lamp as claimed in claim 1, wherein the lamp shell has a shell body and a shell back mounted together, an abut portion being accommodated in the lamp shell and on the shell body for locking with the lock portion of the dissipation substrate.

7. The multi-source shadowless operating lamp as claimed in claim 1, wherein each LED set has an LED unit mounted on the mount surface of the dissipation substrate, a lens being provided on the LED unit and corresponding to the extending line of the mount surface.

8. The multi-source shadowless operating lamp as claimed in claim 1, wherein the slots of the dissipation substrate are distributed in multiple arrays.

9. The multi-source shadowless operating lamp as claimed in claim 8, wherein a bottom surface of the dissipation substrate has enlarged area toward a direction far away from the central base, and the number of the slots of each array increases toward a direction far away from the central base.

10. The multi-source shadowless operating lamp as claimed in claim 1, wherein a bottom surface of the dissipation substrate has multiple slots thereof, and each slot has a mount surface on a bottom thereof.

* * * * *